US009404496B2

(12) United States Patent
Inoue et al.

(10) Patent No.: US 9,404,496 B2
(45) Date of Patent: Aug. 2, 2016

(54) OIL RETURN PASSAGE STRUCTURE FOR OIL PUMP

(71) Applicant: YAMADA MANUFACTURING CO., LTD, Kiryu-shi (JP)

(72) Inventors: Takamichi Inoue, Kiryu (JP); Atsushi Yanagisawa, Kiryu (JP)

(73) Assignee: YAMADA MANUFACTURING CO., LTD., Kiryu-Shi, Gunma (JP)

( * ) Notice: Subject to any disclaimer, the term of this patent is extended or adjusted under 35 U.S.C. 154(b) by 90 days.

(21) Appl. No.: 14/333,225

(22) Filed: Jul. 16, 2014

(65) Prior Publication Data

US 2015/0037193 A1 Feb. 5, 2015

(30) Foreign Application Priority Data

Jul. 30, 2013 (JP) ..... 2013-157322
Jun. 12, 2014 (JP) ..... 2014-121546

(51) Int. Cl.
*F03C 4/00* (2006.01)
*F04C 2/00* (2006.01)
(Continued)

(52) U.S. Cl.
CPC ..... *F04C 15/0092* (2013.01); *F04C 2/086* (2013.01); *F04C 2/102* (2013.01); *F04C 14/24* (2013.01); *F04C 14/26* (2013.01); *F04C 15/06* (2013.01); *F04C 28/26* (2013.01); *F04C 29/028* (2013.01); *F04C 29/12* (2013.01)

(58) Field of Classification Search
CPC ..... F04C 2/102; F04C 2/084; F04C 2/086; F04C 2/18; F04C 14/24; F04C 14/26; F04C 28/26; F04C 15/06; F04C 15/0042; F04C 29/12; F04C 29/02; F04C 29/028; F04B 13/02
USPC ..... 418/15, 75–77, 171, 180, 206.8; 417/310, 282, 302, 304
See application file for complete search history.

(56) References Cited

U.S. PATENT DOCUMENTS 6,086,337 A * 7/2000 Watanabe ..... F04C 14/26 417/310
6,168,391 B1 * 1/2001 Ono ..... F04C 14/26 417/310

(Continued)

FOREIGN PATENT DOCUMENTS

JP 63-246482 A 10/1988
JP 07145785 A * 6/1995 ..... F04C 2/102

OTHER PUBLICATIONS

United States Office Action dated Dec. 2, 2014 in co-pending U.S. Appl. No. 14/333,157.

*Primary Examiner* — Theresa Trieu
(74) *Attorney, Agent, or Firm* — McGinn IP Law Group, PLLC

(57) ABSTRACT

An oil pump has a pump body, a pump cover, an outer rotor, and an inner rotor. The pump body includes a rotor chamber, a first inlet port, a first outlet port, a first inlet passage, a first outlet passage, a relief valve, a relief chamber formed on a discharge side of the relief valve, and a first oil return passage formed from the relief chamber to the first inlet passage. The pump cover has a second oil return passage. The first oil return passage is formed in an inner circumferential support wall of the rotor chamber as a groove-like recess and opens along an outer circumferential surface of the outer rotor. A support protrusion is formed near a portion where the second oil return passage is formed to support a front surface, in a radial direction, of the outer rotor.

8 Claims, 8 Drawing Sheets

ENLARGED VIEW OF PART α

(51) Int. Cl.

| | |
|---|---|
| ***F04C 18/00*** | (2006.01) |
| ***F04C 15/00*** | (2006.01) |
| ***F04C 28/26*** | (2006.01) |
| ***F04C 29/02*** | (2006.01) |
| ***F04C 29/12*** | (2006.01) |
| ***F04C 14/24*** | (2006.01) |
| ***F04C 2/10*** | (2006.01) |
| ***F04C 14/26*** | (2006.01) |
| ***F04C 2/08*** | (2006.01) |
| ***F04C 15/06*** | (2006.01) |

(56) References Cited

U.S. PATENT DOCUMENTS

| | | | | |
|---|---|---|---|---|
| 7,435,066 | B2 * | 10/2008 | Enzaka | F04C 15/06 418/61.3 |
| 7,588,011 | B2 * | 9/2009 | Ono | F04C 14/24 417/310 |
| 2015/0037193 | A1 | 2/2015 | Inoue et al. | |

* cited by examiner

Fig. 1A
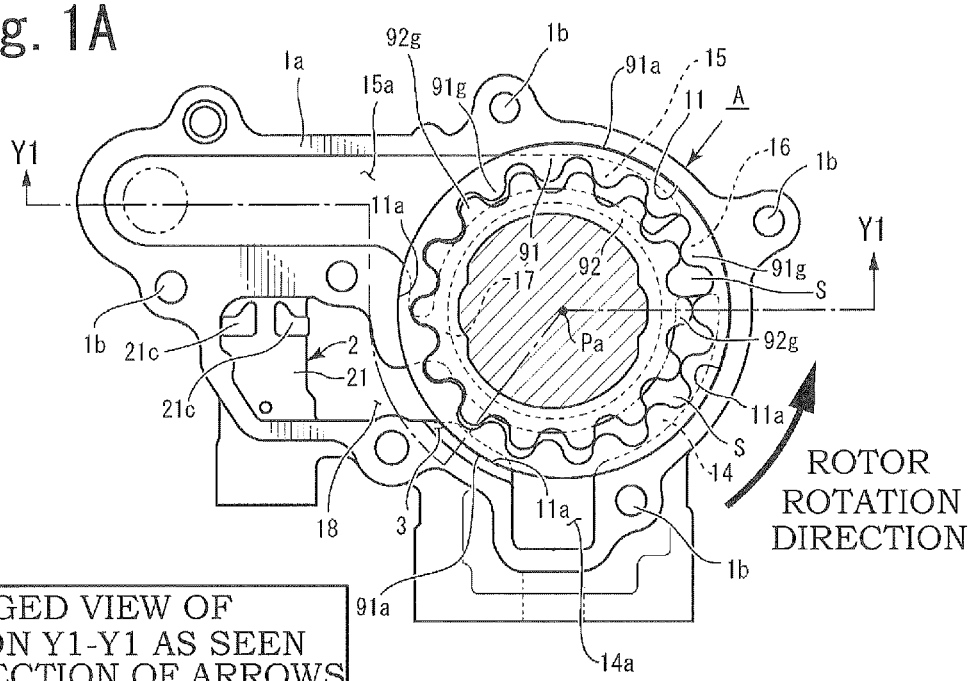
ENLARGED VIEW OF SECTION Y1-Y1 AS SEEN IN DIRECTION OF ARROWS
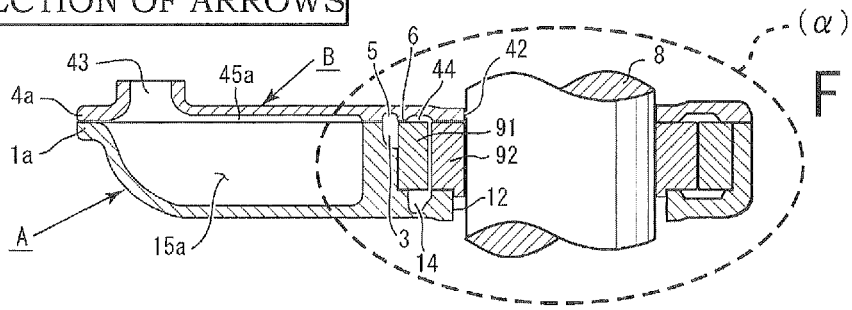
Fig. 1B
Fig. 1C
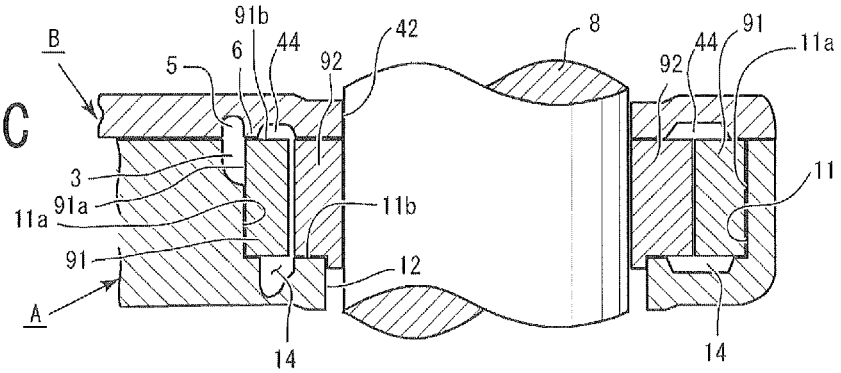
ENLARGED VIEW OF PART α

SECTION Y2-Y2 AS SEEN IN DIRECTION OF ARROWS

ENLARGED VIEW OF SECTION Y3-Y3
AS SEEN IN DIRECTION OF ARROWS

ENLARGED VIEW OF PART β

ENLARGED VIEW OF PART γ

SECTION Y4-Y4 AS SEEN IN DIRECTION OF ARROWS

ENLARGED VIEW OF PART δ

SECTION Y5-Y5 AS SEEN IN DIRECTION OF ARROWS

ENLARGED VIEW OF PART ε

SECTION Y6-Y6 AS SEEN IN DIRECTION OF ARROWS

OIL RETURN PASSAGE STRUCTURE FOR OIL PUMP

BACKGROUND OF THE INVENTION

1. Field of the Invention

The present invention relates to a configuration of an oil pump that can achieve a size reduction of the entire pump, reduction in wear of the rotor during operation and that can also achieve longer pump life and reduction in production cost.

2. Description of the Related Art

There are, as conventionally known, internal gear oil pumps with a relief valve. Japanese Patent Application Laid-open No. S63-246482 discloses a specific configuration of such an oil pump (see FIGS. 8A and 8B). The pump according to Japanese Patent Application Laid-open No. S63-246482 has in general a configuration, in which a circular recess 6 in which inner and outer rotors are arranged has a smooth cover attachment surface 22 therearound to attach a cover 24, and a plurality of bolt holes 23 drilled at suitable locations for fastening the cover 24.

An oil return passage 26 is formed in the cover attachment surface 22 in the form of a groove from near a discharge chamber 11 toward an inlet chamber 10. One end of this oil return passage 26 opens to an inlet passage 12, while the other end extends as far as to a portion adjacent the discharge chamber 11. The cover attachment surface 22 is thus divided into a pump chamber-side portion 22*a* that surrounds the circular recess 6, and an outer portion 22*b*.

A side hole 27*a*, which is drilled in a middle position of a relief passage 27 that opens to an outlet passage 14, opens to the oil return passage 26. A known relief valve 28 is mounted in the relief passage 27, so that lubricating oil under excess pressure is discharged into the oil return passage 26 through the side hole 27*a* to flow back to the inlet chamber 10 when the pressure of discharged oil exceeds a predetermined value.

SUMMARY OF THE INVENTION

According to Japanese Patent Application Laid-open No. S63-246482, the pump chamber-side portion 22*a* is provided between the oil return passage 26 and the circular recess 6 so as to separate the oil return passage 26 and the circular recess 6. Accordingly, the pump casing 5 is increased in size radially outward by the width of the pump chamber-side portion 22*a*.

The oil return passage 26 is formed independently of and located away from the circular recess 6. The pump casing 5 has a complex shape because of such a configuration, which causes high production cost. The flow path of the relief oil is long since the oil return passage 26 is formed at a position away from the circular recess 6, because of which the relief oil may not flow smoothly and it is highly likely that the pressure relief action may not be performed properly.

The technical solutions (objects) of the present invention are to achieve: efficient return of relief oil to the inlet side by a relief valve to ensure a favorable pressure relief action; retardation of wear of the rotor mounted in the pump body to increase pump life; a very compact design; and simple production.

Through vigorous research, the inventors have achieved the above objects by providing an oil pump, which, according to a first aspect of the present invention, includes: a pump body; a pump cover; an outer rotor; and an inner rotor, the pump body including a rotor chamber having an inner circumferential support wall on an inner circumferential side, a first inlet port and a first outlet port formed in the rotor chamber, an inlet passage communicating with the first inlet port, an outlet passage communicating with the first outlet port, a relief valve allowing oil to flow from the outlet passage to the inlet passage by relieving pressure, a relief chamber formed on a discharge side of the relief valve, and a first oil return passage formed from the relief chamber to the inlet passage; the pump cover including a second inlet port and a second outlet port, and a second oil return passage facing and communicating with the first oil return passage; the outer rotor being supported by the inner circumferential support wall of the rotor chamber; and the inner rotor being arranged on an inner circumferential side of the outer rotor. The first oil return passage is formed in the inner circumferential support wall as a groove-like recess that opens along an outer circumferential surface of the outer rotor. A support protrusion is formed near a portion where the second oil return passage is formed in the pump cover to support a front surface, in a radial direction, of the outer rotor.

According to a second aspect of the present invention, in the oil pump according to the first aspect, each of the first oil return passage and the second oil return passage is formed at and around a symmetric point of a maximum partition part located between a trailing end of the inlet port and a leading end of the outlet port relative to a center point of the rotor chamber, whereby the above objects were achieved.

According to a third aspect of the present invention, in the oil pump according to the first aspect, the first oil return passage is formed at an upper end portion in a depth direction of the inner circumferential support wall and opened in a surface portion of the rotor chamber, whereby the above objects were achieved.

According to a fourth aspect of the present invention, in the oil pump according to the third aspect, the first oil return passage is formed to a depth from a surface of the rotor chamber less than half a thickness in an axial direction of the outer rotor, whereby the above objects were achieved.

Through vigorous research, the inventors have achieved the above objects by providing an oil pump, which, according to a fifth aspect of the present invention, includes: a pump body; a pump cover; an outer rotor; and an inner rotor, the pump body including a rotor chamber having an inner circumferential support wall on an inner side, a first inlet port and a first outlet port formed in the rotor chamber, an inlet passage communicating with the first inlet port, an outlet passage communicating with the first outlet port, a relief valve allowing oil to flow from the outlet passage to the inlet passage by relieving pressure, a relief chamber formed on a discharge side of the relief valve, and a first oil return passage formed from the relief chamber to the inlet passage; the pump cover including a second inlet port and a second outlet port, and a second oil return passage facing and communicating with the first oil return passage; the outer rotor being supported by the inner circumferential support wall of the rotor chamber; and the inner rotor being arranged on an inner circumferential side of the outer rotor. The first oil return passage is formed as a gap extending to a same depth in an axial direction as a depth of the rotor chamber between a body wall portion, located between the relief chamber and the inlet passage, and an outer circumferential surface of the outer rotor. A support protrusion is formed near a portion where the second oil return passage is formed in the pump cover to support a front surface, in a radial direction, of the outer rotor.

According to a sixth aspect of the present invention, in the oil pump according to the first aspect, the support protrusion is sandwiched between the second inlet port on a radially inner side and the second oil return passage on a radially outer side, and formed as an independent protrusion, whereby the above objects were achieved. According to a seventh aspect of the present invention, in the oil pump according to the fifth aspect, the support protrusion is sandwiched between the second inlet port on a radially inner side and the second oil return passage on a radially outer side, and formed as an independent protrusion, whereby the above objects were achieved. According to an eighth aspect of the present invention, in the oil pump according to the first aspect, the first oil return passage is formed by a gap formed in an upper portion of the inner circumferential support wall and by a deep groove formed on a radially outer side of the inner circumferential support wall in close proximity thereto, so as to communicate the relief chamber with the inlet passage, the deep groove communicating with the gap, whereby the above objects were achieved.

According to the present invention, the first oil return passage on the pump body side is formed in the inner circumferential support wall from the relief chamber to the inlet passage as a groove-like recess that opens along an outer circumferential surface of the outer rotor. According to this configuration, in the first return oil passage, the outer circumferential surface of the outer rotor forms part of the wall of the oil return passage.

Therefore, the first oil return passage of the present invention is not a separate groove-like recess formed at a position away from the rotor chamber of the pump body as seen in conventional pumps, but rather, it forms a groove together with the outer circumferential surface of the outer rotor. Accordingly, the oil pump of the present invention can be made smaller and more lightweight than conventional counterparts.

Moreover, a second oil return passage is formed in the pump cover such as to face and communicate with the first oil return passage of the oil pump body, so that the overall cross-sectional area of the oil return passage is the sum of the cross-sectional areas of the first oil return passage of the pump body and the second oil return passage of the pump cover.

As the oil return passage formed in the pump body and pump cover has a sufficient and necessary cross-sectional area that is the sum of the cross-sectional areas of both first and second oil return passages, and as the first oil return passage is formed to open along the outer circumferential surface of the outer rotor, with the first and second oil return passages, the oil pump is kept compact and the radial dimension of the oil pump body is minimized.

Moreover, the portion of the inner circumferential support wall of the rotor chamber where the first oil return passage is formed does not contact the outer circumferential surface of the outer rotor. Therefore, the area of surface where the rotor chamber and the outer rotor substantially contact each other is reduced, and the smaller contact area leads to lower friction resistance, whereby drive loss is reduced and fuel economy is increased.

The support protrusion formed with the second oil return passage of the oil pump cover partially supports the front surface of a portion at the distal end in the radial direction of the outer rotor, as well as restricts axial displacement of the outer rotor. As the support protrusion supports the front surface in the radial direction of the outer rotor, the outer rotor is unlikely to tilt inside the rotor chamber, and thus the outer rotor is prevented from tilting and abutting the inner circumferential support wall of the oil pump body obliquely, and possible damage to the outer rotor is prevented.

BRIEF DESCRIPTION OF THE DRAWINGS

FIG. 1A is a partially sectional front view of a first embodiment of the present invention, FIG. 1B is a cross-sectional view as seen from the direction of arrows Y1-Y1 in FIG. 1A, and FIG. 1C is an enlarged view of part α in FIG. 1B;

DESCRIPTION OF THE PREFERRED EMBODIMENTS

Figure 2A:
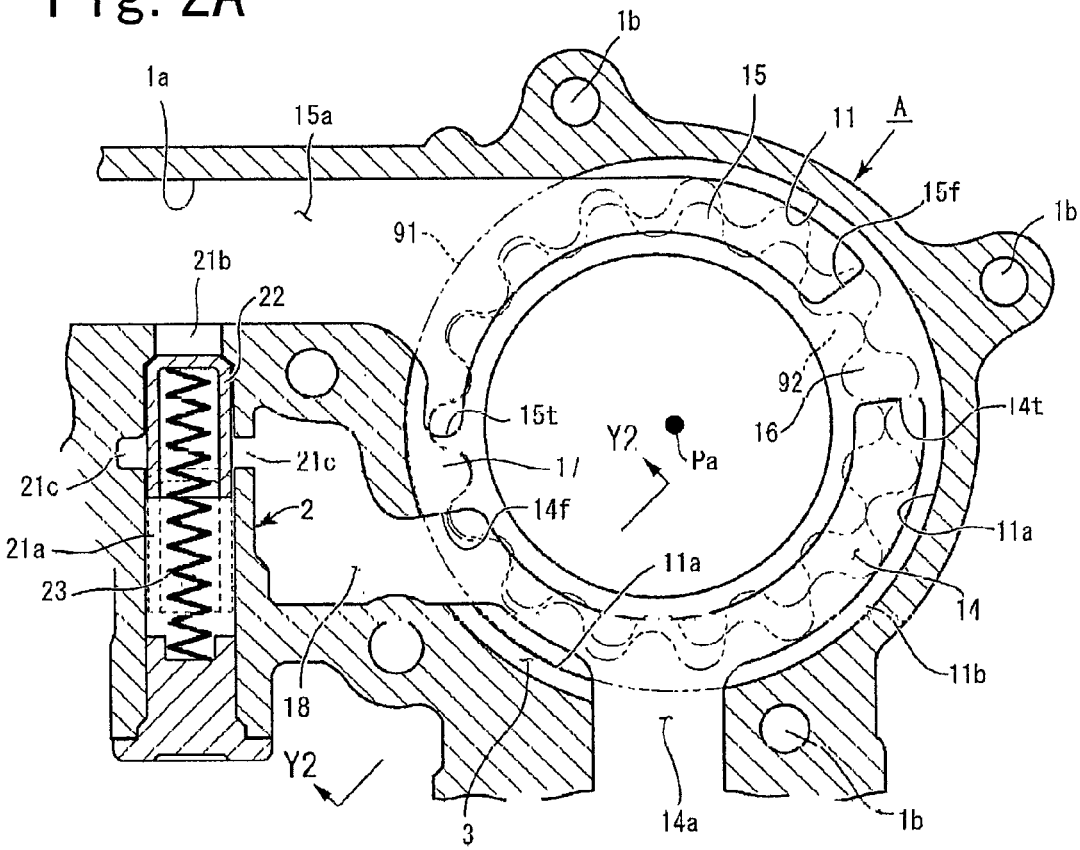
FIG. 2A is a partially sectional front view of a pump body in the first embodiment.

Hereinafter, embodiments of the present invention will be described with reference to the drawings. The oil pump according to the present invention is generally comprised of a pump body A, a pump cover B, an outer rotor 91, and an inner rotor 92 (see FIG. 1). The pump body A is comprised of a rotor chamber 11, a first inlet port 14, a first outlet port 15, and a relief valve 2 (see FIG. 2).

The rotor chamber 11 is made up of an inner circumferential support wall 11*a* and a bottom 11*b*. The pump body A has a body wall portion 1*a* at the outer periphery. The distal end of the body wall portion 1*a* is formed flat. Suitably spaced bolt holes 1*b* are formed in the body wall portion 1*a* for fixedly attaching the body to the pump cover B to be described later with fastening means such as bolts.

The outer rotor 91 and inner rotor 92 are trochoid or substantially trochoid gears. The outer rotor 91 has a plurality of inner teeth 91*g* formed on the inner periphery, while the inner rotor 92 has a plurality of outer teeth 92*g*. The inner rotor 92 has one fewer number of outer teeth 92*g* than the number of inner teeth 91*g* of the outer rotor 91, so that there are formed a plurality of interteeth spaces S between the inner teeth 91*g* of the outer rotor 91 and the outer teeth 92*g* of the inner rotor 92.

A shaft hole 12 is formed in the bottom 11*b* of the rotor chamber 11 for a drive shaft 8 to pass through (see FIG. 1). Also formed in the bottom 11*b* are the first inlet port 14 and the first outlet port 15. Between the trailing end 14*t* of the first inlet port 14 and the leading end 15*f* of the first outlet port 15 is formed a maximum partition part 16, while, between the trailing end 15*t* of the first outlet port 15 and the leading end 14*f* of the first inlet port 14 is formed a minimum partition part 17 (see FIG. 2).

A first inlet passage 14*a* communicates with the first inlet port 14. The first inlet passage 14*a* communicates with the outside of the pump body A and allows oil to flow in from a lubrication circuit outside the pump body A. A first outlet passage 15*a* communicates with the first outlet port 15. The first inlet outlet passage 15*a* allows oil to flow out to the lubrication circuit outside the pump body A.

The inner circumferential support wall 11*a* of the rotor chamber 11 is a portion that holds and rotatably supports the outer rotor 91. The inner circumferential support wall 11*a* forms a cylindrical inner wall surface, which is non-continuous at portions where it intersects with the first inlet port 14 and the first outlet port 15 (see FIG. 2A). Namely, the inner circumferential support wall 11*a* of the rotor chamber 11 is formed from a plurality of wall parts, which hold the outer circumferential surface 91*a* of the outer rotor 91 (see FIG. 4A).

The relief valve 2 is provided between the first inlet port 14 and the first outlet port 15, and serves to return oil from the first outlet port 15 side to the first inlet port 14 side when the pressure of discharged oil exceeds a predetermined value. A valve member passage 21*a* is formed inside a valve housing 21, and a relief passage 21*b* is formed at one end in the longitudinal direction of the valve member passage 21*a* to communicate with the first Wet outlet passage 15*a*. Part of the oil flowing through the first outlet passage 15*a* enters the valve member passage 21*a* through the relief passage 21*b* as relief oil.

A relief drain hole 21*c* is formed in the valve housing 21, so that the valve member passage 21*a* inside the valve housing 21 communicates with the outside. The relief drain hole 21*c* is opened and closed by a valve member 22 to be described later. The relief drain hole 21*c* is opened to relieve pressure (see FIG. 4A).

The valve member 22 and a resilient member 23 are arranged inside the valve member passage 21*a* such that the resilient member 23 resiliently presses the valve member 22 to close the relief passage 21*b*. More specifically, a coil spring is used as the resilient member 23. A relief chamber 18 is formed around a portion where the relief drain hole 21*c* is formed in the valve housing 21 (see FIG. 1A, FIG. 2A, FIG. 4A, and others).

The relief chamber 18 is a cavity (space) that communicates the relief drain hole 21*c* with the first inlet port 14. The relief chamber 18 serves to deliver the oil drained from the relief drain hole 21*c* into the first inlet port 14.

Next, a first oil return passage 3 in the first embodiment of the present invention will be described. The first oil return passage 3 is formed in a suitable region of the inner circumferential support wall 11*a* of the rotor chamber 11. The first oil return passage 3 is formed at a location opposite from the maximum partition part 16, with the rotation center Pa of the outer rotor 91 being in the middle as a center point, i.e., at a symmetrical point (see FIG. 2A). This location includes the surrounding region. The first oil return passage 3 is formed in the inner circumferential support wall 11*a* between the relief chamber 18 and the first inlet passage 14*a*.

The first oil return passage 3 is formed as a substantially arcuate recess extending along the circumferential direction of the rotor chamber 11 in a suitable region of the inner circumferential support wall 11*a* (see FIG. 2). The first oil return passage 3 is formed to have a substantially L-shaped cross-sectional shape in a section orthogonal to the circumferential direction from the upper end face to the inner side face of the inner circumferential support wall 11*a*. The corner of the first oil return passage 3 with a substantially L-shaped cross-sectional shape may either be rounded or orthogonal.

Figure 2B:
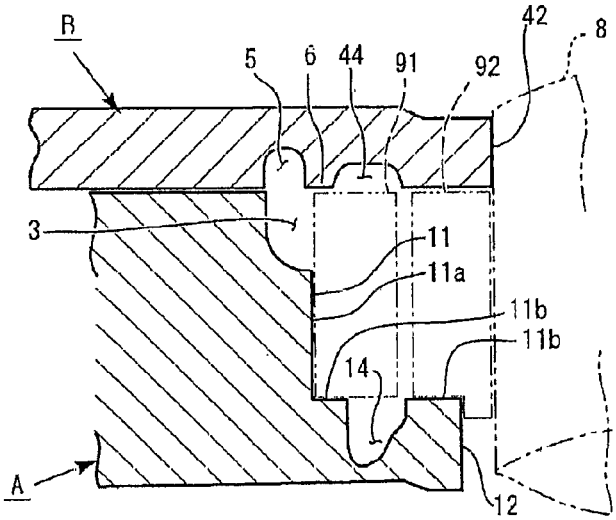
FIG. 2B is a cross-sectional view as seen from the direction of arrows Y2-Y2 in FIG. 2A.

The inner circumferential support wall 11*a* is shaped like the rest thereof below the first oil return passage 3 in the depth direction so as to support the outer circumferential surface 91*a* of the outer rotor 91 housed in the rotor chamber 11 (see FIGS. 1B and 1C and FIG. 2B). Therefore, the outer rotor 91 is prevented from moving in radial directions by parts of the inner circumferential support wall 11*a* supporting the outer circumferential surface 91*a* of the outer rotor 91. As radial rocking movement of the outer rotor 91 is reduced, knocking noise produced by the outer rotor 91 colliding the rotor chamber 11, or damage to the outer rotor 91, can be reduced.

Part of the outer circumferential surface 91*a* of the outer rotor 91 that passes the region of the first oil return passage 3 forms the substantially groove-like recess together with the first oil return passage 3. The first oil return passage 3 is a fluid passage that communicates the relief chamber 18 with the first inlet passage 14*a* and allows the relief oil to return from the relief chamber 18 back to the first inlet passage 14*a* through the first oil return passage 3 (see FIG. 2A).

Figure 4A:
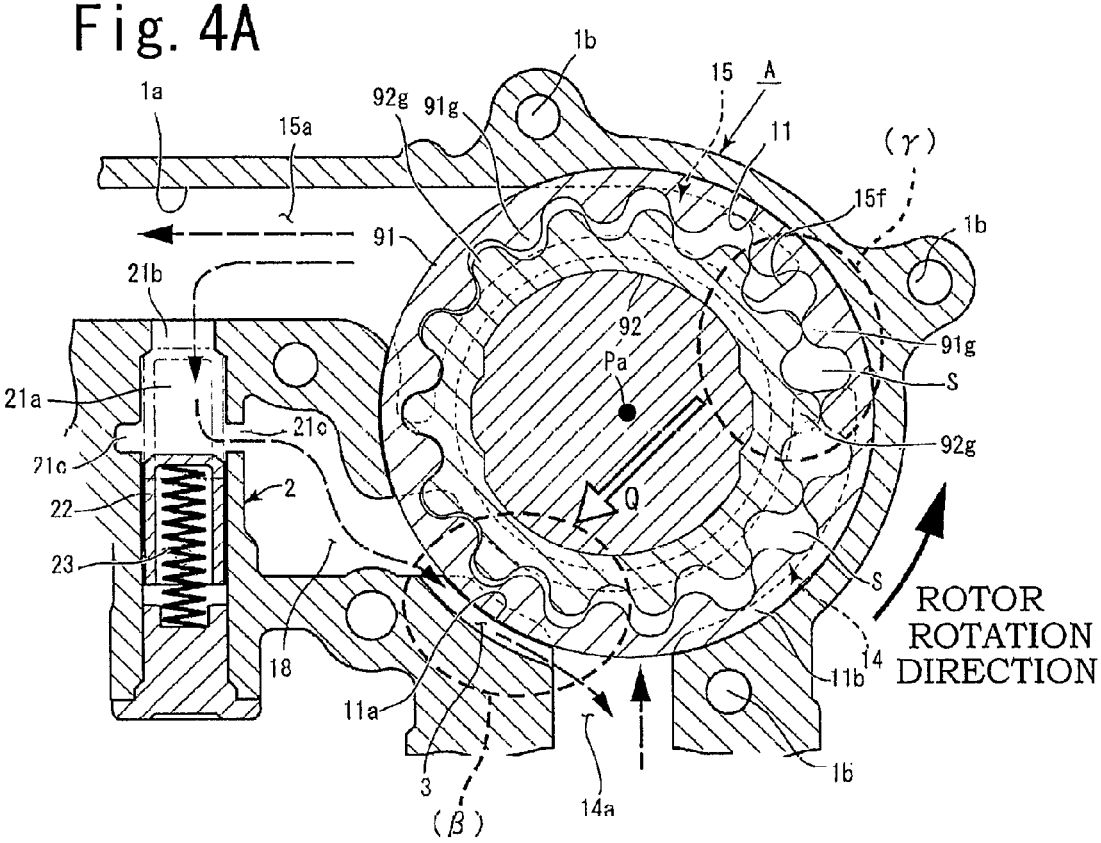
FIG. 4A is a longitudinal cross-sectional front view of a pressure relief action in the first embodiment.
Figure 4B:
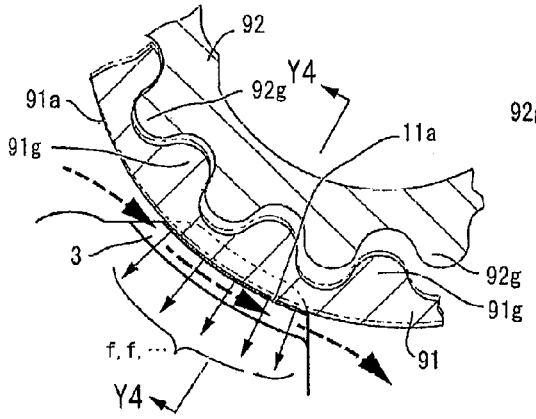
FIG. 4B is an enlarged view of part β in FIG. 4A.

The relief oil flowing through the first oil return passage 3 thus makes direct contact with the outer circumferential surface 91*a* of the outer rotor 91, so that, as the outer rotor 91 rotates inside the rotor chamber 11, oil can be distributed between the outer circumferential surface 91*a* of the outer rotor 91 and the inner circumferential support wall 11*a* (see FIG. 4A and FIG. 4B).

Since the first oil return passage 3 is formed along the outer circumferential surface 91*a* of the outer rotor 91, the pump body A can be made smaller as compared to the conventional pump that has the oil passage at a position away from the rotor chamber 11. The contact area between the inner circumferential support wall 11*a* and the outer circumferential surface 91*a* of the outer rotor 91 is reduced in the region where the first oil return passage 3 is formed (see FIGS. 1B and 1C), so that the friction resistance between the outer rotor 91 and the rotor chamber 11 is reduced. Drive loss is accordingly reduced, and fuel economy is improved.

Figure 4C:
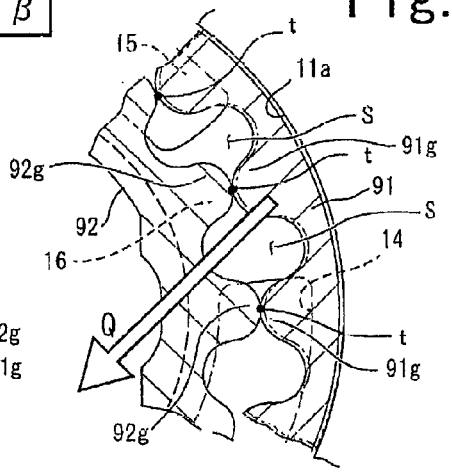
FIG. 4C is an enlarged view of part γ in FIG. 4A.

Moreover, since the first oil return passage 3 is located on the opposite side from the maximum partition part 16 between the trailing end 14*t* of the first inlet port 14 and the leading end 15*f* of the first outlet port 15, with the rotation center Pa of the outer rotor 91 being in the middle (at the symmetric point), oil that flows from the relief chamber 18 back to the first inlet passage 14*a* passes through the first oil return passage 3 (see FIG. 4).

Since the pressure of oil flowing through the first oil return passage 3 is negative, the outer rotor 91 is pulled from the side of the maximum partition part 16 toward the first oil return passage 3 by the force of negative pressure f (see FIG. 4B). The direction in which the outer rotor 91 is pulled by the force of negative pressure f is indicated by arrow Q in FIG. 4A and FIG. 4C.

Therefore, the tip clearance t between the inner teeth of the outer rotor 91 and the outer teeth of the inner rotor 92 on the maximum partition part 16 (see FIG. 4C) is reduced. That is, the seal tightness of the interteeth spaces S between the outer rotor 91 and the inner rotor 92 on the maximum partition part 16 is increased, so that leakage from the outlet side to the inlet side is reduced, and the volume efficiency (ratio of actual discharge to theoretical discharge) can be increased.

Figure 5A:
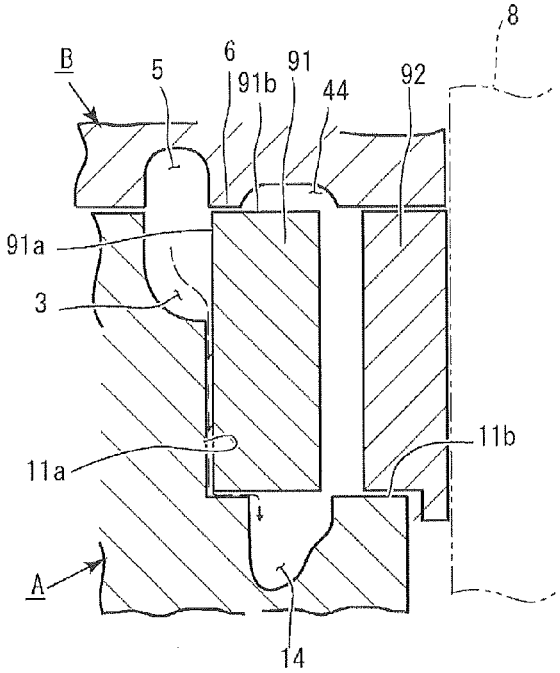
FIG. 5A is an enlarged view as seen from the direction of arrows Y4-Y4 in FIG. 4B.

Moreover, the oil flowing through the first oil return passage 3 can be delivered to the gap between the inner circumferential support wall 11*a* of the rotor chamber 11 and the outer circumferential surface 91*a* of the outer rotor 91 and serves as lubricating oil to allow smooth rotation of the outer rotor 91 (see FIG. 5A).

Next, the relationship between the depth of the first oil return passage 3 and the length in the thickness direction of the outer rotor 91 will be explained. One half the length in the depth direction of the rotor chamber 11 is denoted as Db, while the length in the depth direction of the first oil return passage 3 is denoted as Da (see FIG. 5B). The imaginary line L in the drawing indicates the centerline in the thickness direction of the outer rotor. The depth direction of the rotor chamber 11 and the thickness direction of the outer rotor 91 are the same. The depth Da of the first oil return passage 3 is set smaller than half the length in the depth direction Db of the rotor chamber 11.

Namely, Db>Da.

Therefore, in the region where the first oil return passage 3 is formed, the inner circumferential support wall 11*a* extends from the bottom 11*b* of the rotor chamber 11 in the height direction to a point beyond half the depth of the rotor chamber 11. Accordingly, even if there is created a rotational force M that causes the outer rotor 91 to swing and tilt relative to the rotor chamber 11 around the contact point P1 between the lower end in the depth direction of the first oil return passage 3 and the outer circumferential surface 91*a* of the outer rotor 91, the outer circumferential surface 91*a* of the outer rotor 91 is supported by part of the inner circumferential support wall 11*a* up to a point higher than half the thickness of the outer rotor.

That is, the outer rotor 91 is supported by the inner circumferential support wall 11*a* over a range that extends beyond the center of gravity in the axial direction of the outer circumferential surface 91*a* (midpoint of the thickness of the outer rotor 91). Therefore, the reaction force F1 from the contact point P1 against the outer rotor 91 abutting the contact point P1 acts on a point higher than the midpoint of the thickness of the outer rotor 91 (see FIG. 5B). This configuration makes it difficult for the outer rotor 91 to tilt inside the rotor chamber 11 and thus the outer rotor 91 is prevented from abutting the inner circumferential support wall 11*a* obliquely, and possible damage to the outer rotor 91 is reduced.

Figure 3A:
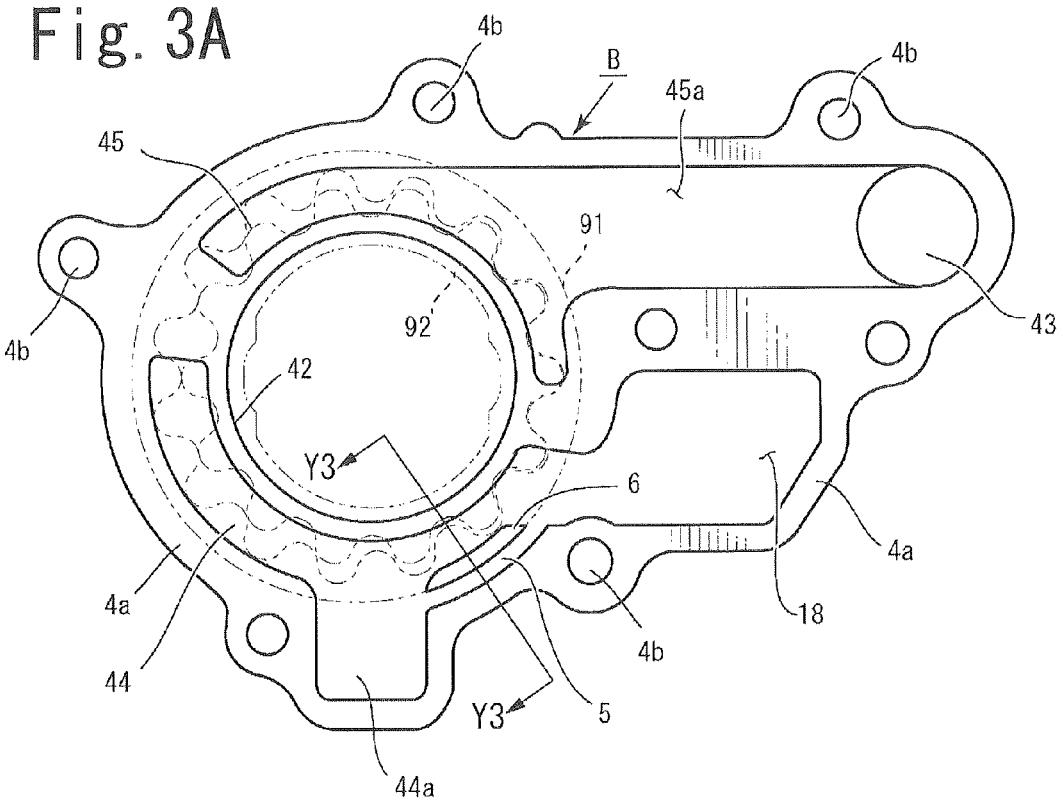
FIG. 3A is a front view of a pump cover.

Next, the pump cover B will be described. The pump cover B is formed in a shape substantially the same as but symmetric to the opening shape on the front side of the pump body A (see FIG. 3A). FIG. 3A is a front view of the pump cover B. The front side of the pump cover B here is the side that faces the front opening of the pump body A (see FIG. 1B).

The pump cover B has parts corresponding to the first inlet port 14, first inlet passage 14*a*, first outlet port 15, first outlet passage 15*a*, the first oil return passage 3 and others of the pump body A as will be shown below, being formed at corresponding locations. The pump cover B has a cover wall portion 4*a*, in which bolt holes 4*b* are formed with suitable spacing. In the pump cover B are formed a shaft hole 42, a discharge port 43, a second inlet port 44, a second inlet passage 44*a*, a second outlet port 45, a second outlet passage 45*a*, and a second oil return passage 5.

The second inlet port 44, second inlet passage 44*a*, second outlet port 45, and second outlet passage 45*a* of the pump cover B are located correspondingly to the first inlet port 14, first inlet passage 14*a*, first outlet port 15, and first outlet passage 15*a*, of the pump body A, so that, with the pump cover B being attached to the pump body A, their positions match each other.

Figure 3B:
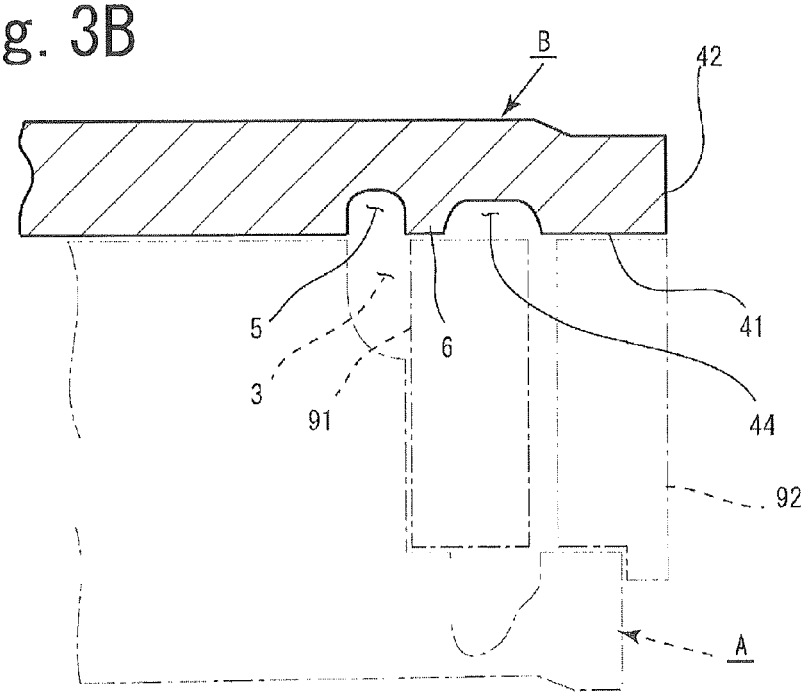
FIG. 3B is a cross-sectional view as seen from the direction of arrows Y3-Y3 in FIG. 3A.

The second oil return passage 5 is located at a position where it will face and communicate with the first oil return passage 3 of the pump body A when the pump cover B is attached to the pump body A (see FIG. 1B, FIG. 1C, and FIG. 3B). Thus the overall cross-sectional area of the oil return passage in the present invention is the sum of the cross-sectional area of the second oil return passage 5 and that of the first oil return passage 3.

The oil return passage formed in the pump body A and pump cover B has a sufficient and necessary cross-sectional area that is the sum of the cross-sectional areas of both first and second oil return passages 3 and 5, and the first oil return passage 3 is formed to open along the outer circumferential surface 91*a* of the outer rotor 91. Accordingly, with the first and second oil return passages 3 and 5, a large amount of relief oil can be conveyed, while the oil pump is kept compact and the radial dimension of the pump body A is minimized. The pressure of oil flowing through the second oil return passage 5 is negative.

A support protrusion 6 is formed between the second oil return passage 5 and second inlet port 44 (see FIG. 1B, FIG. 1C, and FIG. 3). More specifically, the support protrusion 6 is sandwiched between the second inlet port 44 on the radially inner side, and the second oil return passage 5 on the radially outer side, and formed as an independent protrusion. The distal end of the support protrusion 6 is formed flat (see FIG. 3B). The support protrusion 6 is formed substantially arcuate along the longitudinal direction of the second oil return passage 5.

Figure 5B:
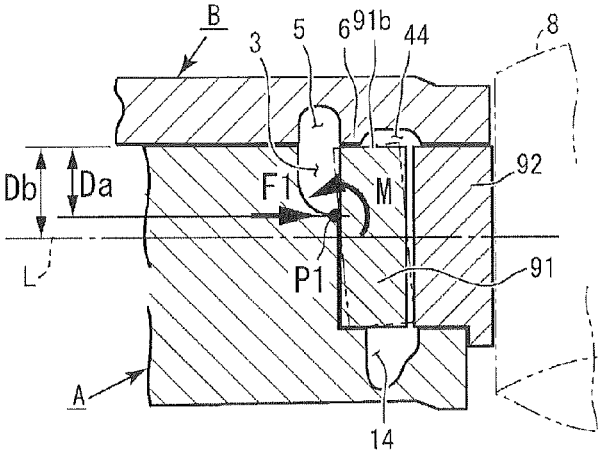
FIG. 5B is an enlarged longitudinal cross-sectional side view of essential parts illustrating how forces act to resist tilting of the outer rotor.
Figure 5C:
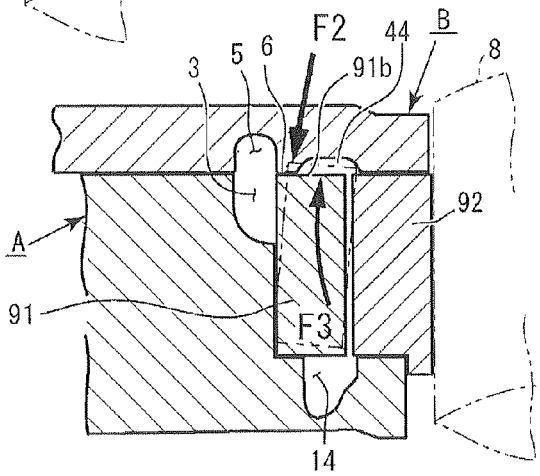
FIG. 5C is an enlarged longitudinal cross-sectional side view of essential parts illustrating how forces act in the pump cover to resist tilting of the outer rotor.

The support protrusion 6 partially and slidably supports a front surface 91*b* at the distal end in the radial direction of the outer rotor 91, with the pump cover B fitted on the pump body A (see FIGS. 1C, 5B and 5C). Therefore, the support protrusion 6 is formed on the same plane as that of the cover wall portion 4*a* of the pump cover B.

The radial front surface 91*b* of the outer rotor 91 is thus supported by the support protrusion 6, so that the outer rotor 91 is unlikely to tilt inside the rotor chamber 11 (see FIG. 5C). Even if a force F2 is generated that causes the outer rotor 91 to tilt obliquely relative to the radial direction inside the rotor chamber 11, a reaction force F3 will act against the support protrusion 6 pressing down the front surface 91*b* of the outer rotor 91, so that the outer rotor is prevented from abutting the inner circumferential surface of the oil pump body obliquely, and thus possible damage to the outer rotor 91 is prevented.

Figure 6A:
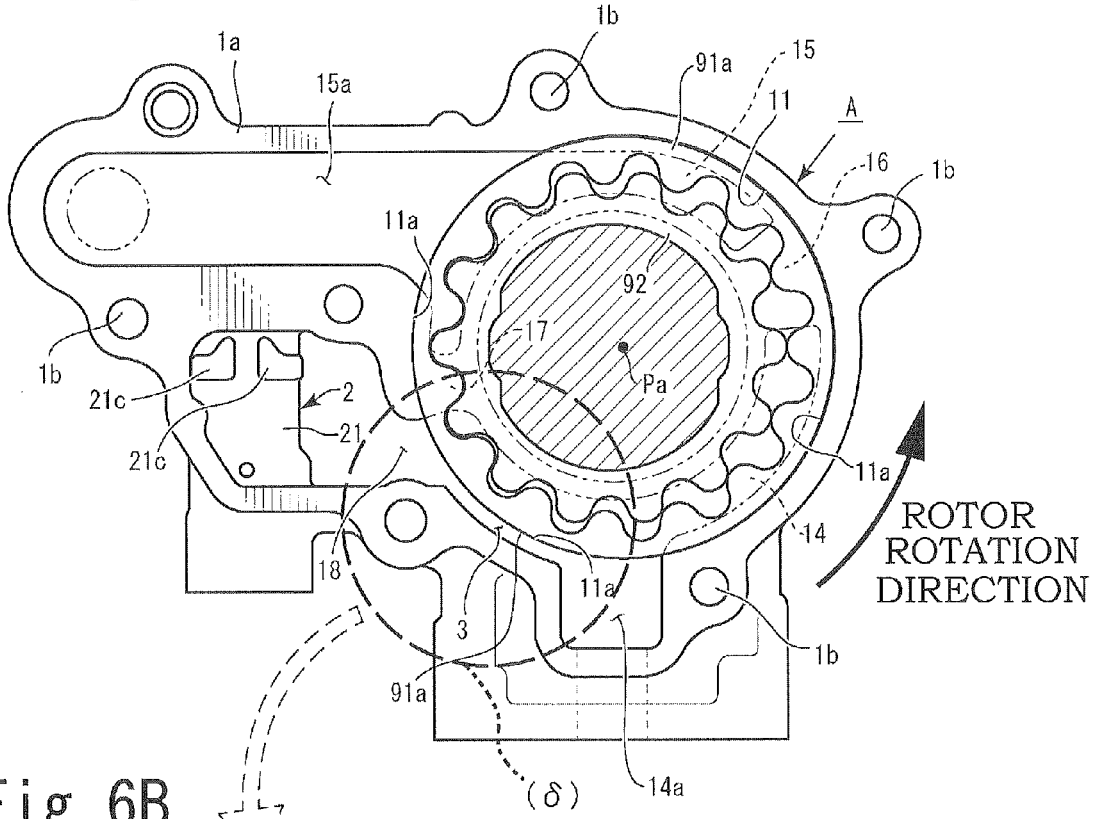
FIG. 6A is a partially sectional front view of a second embodiment of the present invention.
Figure 6B:
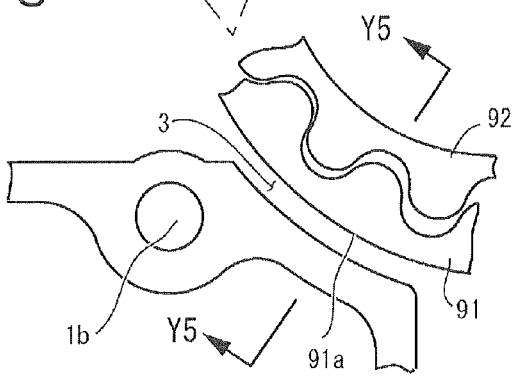
FIG. 6B is an enlarged view of part 8 in FIG. 6A.
Figure 6C:
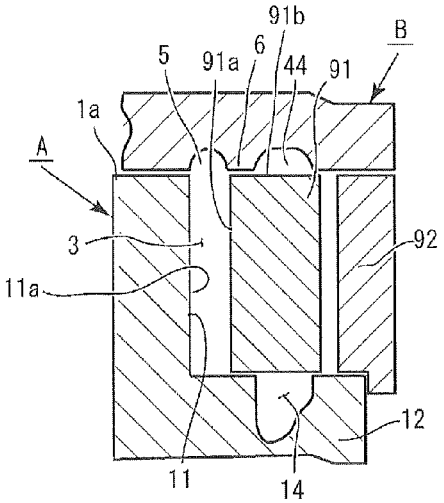
FIG. 6C is a cross-sectional view as seen from the direction of arrows Y5-Y5 in FIG. 6B.

In a second embodiment of the present invention, the first oil return passage 3 is not formed in the inner circumferential support wall 11*a* of the rotor chamber 11 but on the inner side of the body wall portion 1*a* (see FIG. 6). In this embodiment, the first oil return passage 3 extends axially all along the outer circumferential surface 91*a* of the outer rotor 91.

Therefore, the outer circumferential surface 91*a* of the outer rotor 91 passing the region where the first oil return passage 3 is formed does not make contact with the inner circumferential support wall 11*a*. The first oil return passage 3 has a large volume so that it can deliver a large amount of relief oil from the relief chamber 18 to the inlet passage 14*a*. A shallow relief chamber 18 may be formed in the pump cover B at a position corresponding to that of the relief chamber 18 of the pump body A and with substantially the same shape (see FIG. 3A).

Next, a first oil return passage 3 in a third embodiment of the present invention will be described. The first oil return passage 3 of the third embodiment is substantially an embodiment of a narrower concept of the first embodiment described in the foregoing. The first oil return passage 3 of the first embodiment is formed as a groove-like recess in the inner circumferential support wall 11*a* and opens along the outer circumferential surface 91*a* of the outer rotor 91. In contrast, the first oil return passage 3 of the third embodiment is made up of two parts, a gap 31 and a deep groove 32. The gap 31 and the deep groove 32 both extend between the relief chamber 18 and the inlet passage 14*a* and communicate with each other.

Figure 7A:
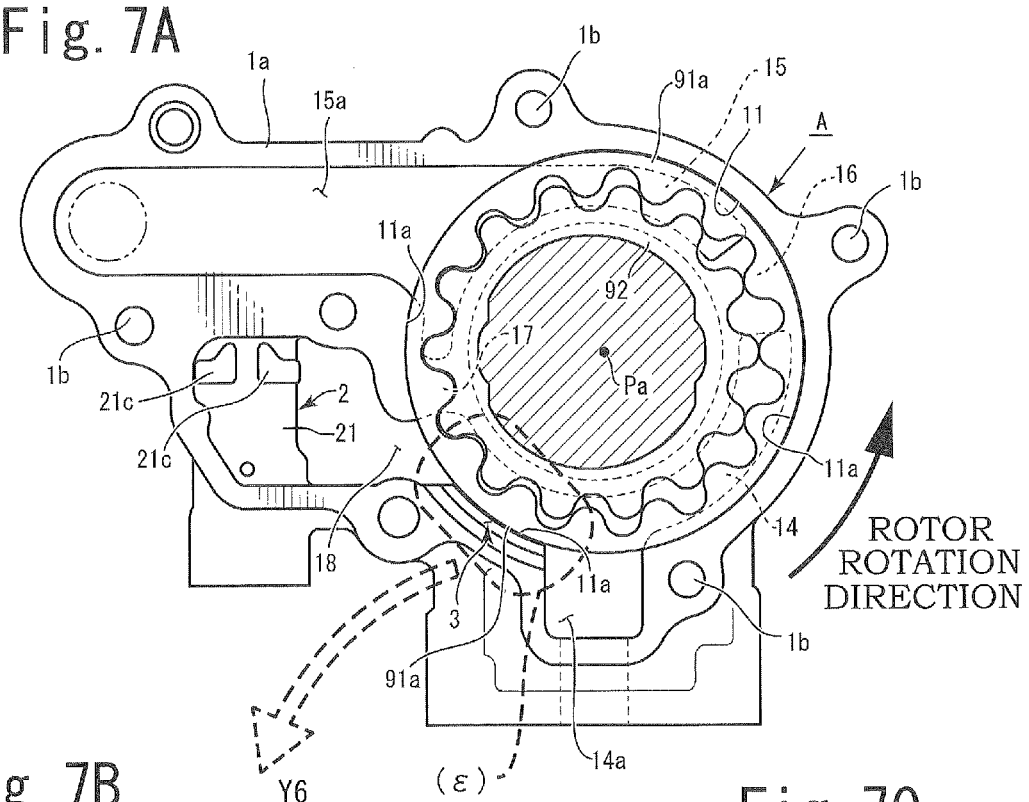
FIG. 7A is a partially sectional front view of a third embodiment of the present invention.
Figure 7B:
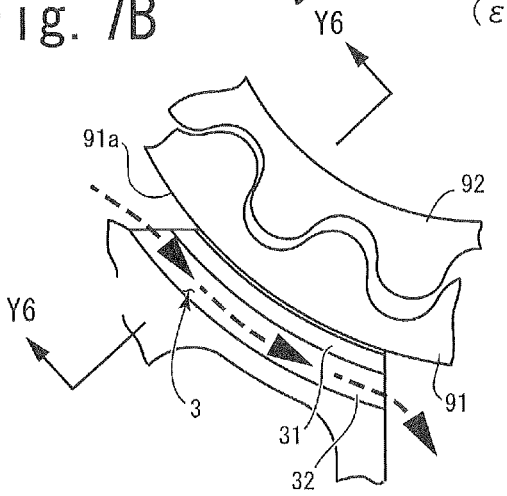
FIG. 7B is an enlarged view of part s in FIG. 7A.
Figure 7C:
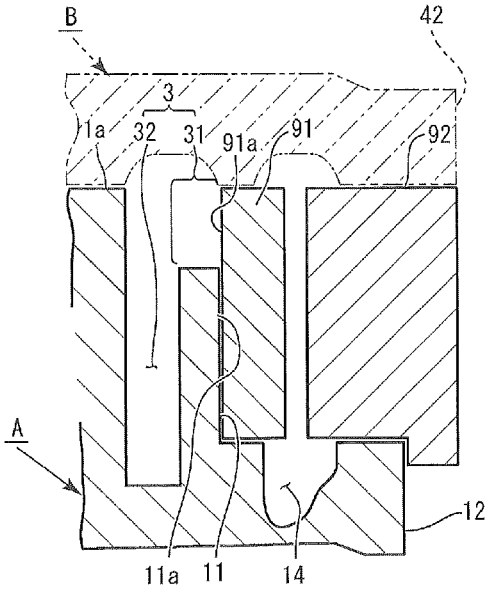
FIG. 7C is a cross-sectional view as seen from the direction of arrows Y6-Y6 in FIG. 7B.
Figure 8A:
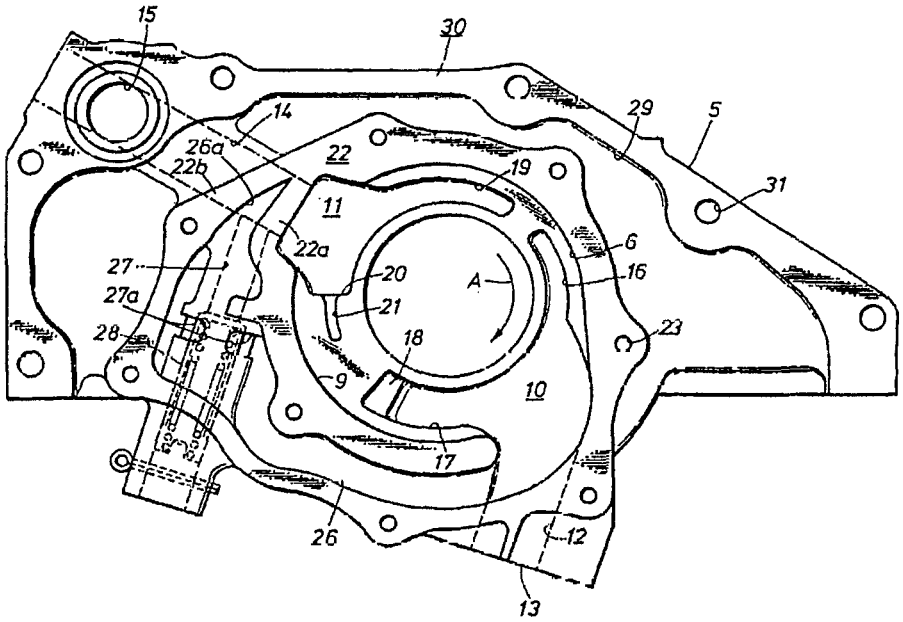
FIG. 8A PRIOR ART
FIGS. 8A-8B illustrate a conventional configuration of an internal gear oil pump with a relief valve.
Figure 8B:
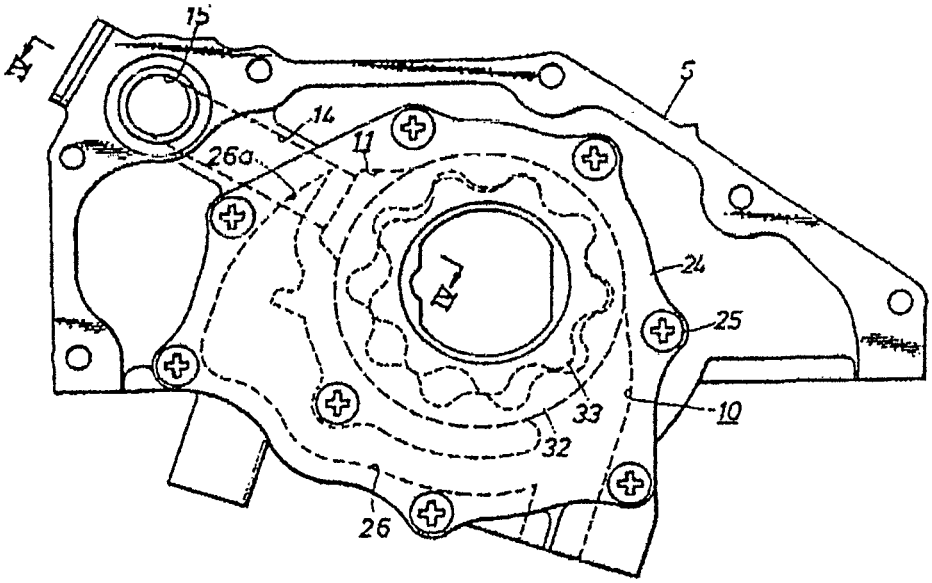
FIG. 8B PRIOR ART

The gap 31 is formed by cutting away an upper portion of the inner circumferential support wall 11*a* along the circumferential direction of the wall 11*a* (see FIG. 7C). In other words, the upper end of the inner circumferential support wall 11*a* is lower in the region where the first oil return passage 3 is formed than other portions of the inner circumferential support wall 11*a*. The top of the inner circumferential support wall 11*a* where the gap 31 is formed is flat, and the height is constant. The gap 31 formed above the inner circumferential support wall 11*a* opens along the outer circumferential surface 91*a* of the outer rotor 91 (see FIG. 7C).

The deep groove 32 is formed on a radially outer side of the inner circumferential support wall 11*a* in close proximity thereto (see FIG. 7B and FIG. 7C). The deep groove 32 is a fluid passage that is arcuate similarly to the inner circumferential support wall 11*a*. The deep groove 32 is formed in communication with and between the relief chamber 18 and the inlet passage 14*a* as mentioned above, the upper part of the deep groove 32 communicating with the gap 31 (see FIG. 7C).

The deep groove 32 has a rectangular cross-sectional shape, and its bottom may be deeper, or shallower than, or equal to the bottom of the rotor chamber 11. The deep groove 32 should preferably be located closest possible to the inner circumferential support wall 11*a*. The first oil return passage 3 formed by such deep groove 32 and gap 31 has a substantially inverted L-shaped cross-sectional shape in a section orthogonal to the circumferential direction of the inner circumferential support wall 11*a* (see FIG. 7C).

Part of the inner circumferential support wall 11*a* stands as an upright wall portion beside the deep groove 32. In the third embodiment, in this way, the gap 31 that forms part of the first oil return passage 3 extends along the circumferential direction of the inner circumferential support wall 11*a*, so that the first oil return passage 3 is open along the outer circumferential surface 91*a* of the outer rotor 91 through the gap 31 (see FIG. 7A and FIG. 7B).

According to the third embodiment, the first oil return passage 3 formed by the gap 31 and the deep groove 32 can return a large amount of relief oil from the relief chamber 18 to the inlet passage 14*a*, so that the pressure relief action can be performed most favorably. The gap 31 allows part of the oil being returned to be distributed between the inner circumferential support wall 11*a* below the gap 31 and the outer circumferential surface 91*a* of the outer rotor 91, so that the outer rotor 91 can rotate very smoothly.

Similarly to the first and second embodiments, the first oil return passage 3 in the third embodiment should preferably be formed at or around a location opposite from the maximum partition part 16, with the rotation center Pa of the outer rotor 91 being in the middle as a center point, i.e., at a symmetric point.

According to the second aspect of the invention, the first oil return passage is located opposite from the maximum partition part between the trailing end of the first inlet port and the leading end of the first outlet port, with the rotation center of the outer rotor being in the middle. The second oil return passage of the pump cover is positioned opposite the first oil return passage of the pump body and in communication with the first oil return passage. Namely, each of the first and second the oil return passages is located at or around a symmetric point of the maximum partition part relative to the rotation center of the outer rotor as the point of symmetry.

Relief oil flowing back from the relief chamber to the inlet passage flows through the first and second oil return passages formed at such a position. Since a negative pressure is created by the relief oil flowing through the first and second oil return passages, the outer rotor is pulled from the maximum partition part toward the oil return passage.

The tip clearance between the inner rotor and the outer rotor is reduced on the maximum partition part, or both rotors almost abut each other, so that airtight interteeth spaces are formed between the outer rotor and the inner rotor. Leakage to the inlet side is thus reduced, and the volume efficiency (actual discharge to theoretical discharge) can be improved.

According to the third aspect of the invention, the first oil return passage is formed at an upper end portion in the depth direction of the inner circumferential support wall and opened to a surface portion of the rotor chamber. It is therefore provided as a recess in the thickness direction of the outer rotor, with a support portion that partially supports the outer circumference of the outer rotor. That is, the inner circumferential support wall exists in the region of the rotor chamber where the first oil return passage is formed.

Since the outer circumferential surface of the outer rotor is supported by the remaining inner circumferential support wall in the region where the first oil return passage is formed, the outer rotor is prevented from moving in radial directions. As radial rocking movement of the outer rotor is reduced, knocking noise produced by the outer rotor colliding the pump body or inner circumferential support wall, or damage to the outer rotor, can be reduced. Since the first oil return passage is formed at the upper end portion in the depth direction of the inner circumferential support wall and opened to a surface portion of the rotor chamber, it can be formed by casting in which the casting with holes is removed from the mold, i.e., there is no need of post-processing such as machining or welding but the groove can be formed from the beginning by casting, so that the production cost can be reduced. Other effects of the present invention as described herein are likewise achieved.

According to the fourth aspect of the invention, the first oil return passage is formed to a depth from the surface of the rotor chamber less than half the thickness in the axial direction of the outer rotor. That is, the outer rotor is supported by the inner circumferential support wall at the center of gravity in the axial direction of the outer circumferential surface (midpoint of the thickness of the outer rotor), so that it is difficult for the outer rotor to tilt, and thus the outer rotor is prevented from tilting and abutting the inner circumferential support wall of the oil pump body obliquely, and possible damage to the outer rotor is reduced.

According to the fifth aspect of the invention, the first oil return passage is formed as a gap between a body wall portion located between the relief chamber and the inlet passage and the outer circumferential surface of the outer rotor. As there is no inner circumferential support wall in the region where the oil return passage is formed in the rotor chamber, the outer circumferential surface of the outer rotor does not contact the inner circumferential support wall there, so that friction resistance is reduced, whereby drive loss is reduced and fuel economy is improved. The oil return passage has a large volume so that it can deliver a large amount of relief oil from the relief chamber to the inlet passage and ensure a favorable pressure relief action. Moreover, the shape of the pump body is made simple, so that molds for casting the pump body can be made simple.

In the sixth and seventh aspects of the invention, the support protrusion is sandwiched between the second inlet port on the radially inner side and the second oil return passage on the radially outer side, and formed as an independent protrusion. As described above, the support protrusion restricts axial displacement of the outer rotor, and as it is formed as an independent protrusion, it supports the front surface of a portion at the distal end in the radial direction of the outer rotor in a minimum area, so that it allows oil to flow sufficiently around itself, and ensures even smoother rotation of the outer rotor.

According to the eighth aspect of the invention, the first oil return passage is formed as a gap formed in an upper portion of the inner circumferential support wall and a deep groove formed on the radially outer side of the inner circumferential support wall in close proximity thereto, such as to communicate the relief chamber with the inlet passage. The deep groove communicates with the gap so that the gap and the deep groove together can return a large amount of relief oil from the relief chamber to the inlet passage, whereby the pressure relief action can be performed most favorably. The gap allows part of the oil being returned to be distributed between the inner circumferential support wall below the gap and the outer circumferential surface of the outer rotor, so that the outer rotor can rotate very smoothly.

What is claimed is:

1. An oil pump, comprising:

a pump body;

a pump cover;

an outer rotor; and an inner rotor, the pump body comprising a rotor chamber having an inner circumferential support wall on an inner circumferential side, a first inlet port and a first outlet port formed in the rotor chamber, an inlet passage communicating with the first inlet port, an outlet passage communicating with the first outlet port, a relief valve allowing oil to flow from the outlet passage to the inlet passage by relieving pressure, a relief chamber formed on a discharge side of the relief valve, and a first oil return passage formed from the relief chamber to the inlet passage;

the pump cover including a second inlet port and a second outlet port, and a second oil return passage facing and communicating with the first oil return passage;

the outer rotor being supported by the inner circumferential support wall of the rotor chamber; and the inner rotor being arranged on an inner circumferential side of the outer rotor, wherein the first oil return passage is formed in the inner circumferential support wall as a groove-like recess that opens along an outer circumferential surface of the outer rotor, and a support protrusion is formed near a portion where the second oil return passage is formed in the pump cover to support a front surface, in a radial direction, of the outer rotor.

2. The oil pump according to claim 1, wherein each of the first oil return passage and the second oil return passage is formed at and around a symmetric point of a maximum partition part located between a trailing end of the inlet port and a leading end of the outlet port relative to a center point of the rotor chamber.

3. The oil pump according to claim 1, wherein the first oil return passage is formed at an upper end portion in a depth direction of the inner circumferential support wall and opened in a surface portion of the rotor chamber.

4. The oil pump according to claim 3, wherein the first oil return passage is formed to a depth from a surface of the rotor chamber less than half a thickness in an axial direction of the outer rotor.

5. The oil pump according to claim 1, wherein the support protrusion is sandwiched between the second inlet port on a radially inner side and the second oil return passage on a radially outer side, and formed as an independent protrusion.

6. The oil pump according to claim 1, wherein the first oil return passage is formed by a gap formed in an upper portion of the inner circumferential support wall and by a deep groove formed on a radially outer side of the inner circumferential support wall in close proximity thereto, so as to communicate the relief chamber with the inlet passage, the deep groove communicating with the gap.

7. An oil pump, comprising:

a pump body;

a pump cover;

an outer rotor; and an inner rotor, the pump body comprising a rotor chamber having an inner circumferential support wall on an inner side, a first inlet port and a first outlet port formed in the rotor chamber, an inlet passage communicating with the first inlet port, an outlet passage communicating with the first outlet port, a relief valve allowing oil to flow from the outlet passage to the inlet passage by relieving pressure, a relief chamber formed on a discharge side of the relief valve, and a first oil return passage formed from the relief chamber to the inlet passage;

the pump cover including a second inlet port and a second outlet port, and a second oil return passage facing and communicating with the first oil return passage;

the outer rotor being supported by the inner circumferential support wall of the rotor chamber; and the inner rotor being arranged on an inner circumferential side of the outer rotor, wherein the first oil return passage is formed as a gap extending to a same depth in an axial direction as a depth of the rotor chamber between a body wall portion, located between the relief chamber and the inlet passage, and an outer circumferential surface of the outer rotor, and a support protrusion is formed near a portion where the second oil return passage is formed in the pump cover to support a front surface, in a radial direction, of the outer rotor.

8. The oil pump according to claim 7, wherein the support protrusion is sandwiched between the second inlet port on a radially inner side and the second oil return passage on a radially outer side, and formed as an independent protrusion.

* * * * *